United States Patent [19]

Welsh et al.

[11] Patent Number: 4,964,214

[45] Date of Patent: Oct. 23, 1990

[54] FLEXIBLE SAFETY RAZORS

[75] Inventors: Norman C. Welsh, Bradfield; Oliver D. Oglesby, Tadley, both of England

[73] Assignee: The Gillette Company, Boston, Mass.

[21] Appl. No.: 378,192

[22] PCT Filed: Jan. 11, 1988

[86] PCT No.: PCT/GB88/00014

§ 371 Date: Jun. 23, 1989

§ 102(e) Date: Jun. 23, 1989

[87] PCT Pub. No.: WO88/04980

PCT Pub. Date: Jul. 14, 1988

[30] Foreign Application Priority Data

Jan. 9, 1987 [GB] United Kingdom ..... 8700518
Apr. 7, 1987 [GB] United Kingdom ..... 8708268

[51] Int. Cl.[5] ..... B26B 21/00
[52] U.S. Cl. ..... 30/49; 30/41
[58] Field of Search ..... 30/41, 47–50, 30/32

[56] References Cited

U.S. PATENT DOCUMENTS

| | | | |
|---|---|---|---|
| 1,288,869 | 12/1918 | Ganzhorn . | |
| 1,741,891 | 12/1929 | Vallon . | |
| 2,229,666 | 1/1941 | Monnet . | |
| 2,460,645 | 2/1949 | MacMicking . | |
| 2,614,321 | 1/1952 | Ackerman . | |
| 3,702,026 | 11/1972 | Scholin | 30/49 |
| 4,302,876 | 12/1981 | Emmett | 30/50 |
| 4,314,404 | 2/1982 | Ruiz | 30/41 |
| 4,498,235 | 1/1985 | Jacobson | 30/47 |
| 4,712,300 | 12/1987 | Hemmeter | 30/41 |
| 4,720,917 | 1/1988 | Solow | 30/49 |

FOREIGN PATENT DOCUMENTS 598803 10/1959 Italy .

*Primary Examiner*—Douglas D. Watts
*Attorney, Agent, or Firm*—Fish & Richardson

[57] ABSTRACT

A safety razor comprises one or more blade members presenting a plurality of cutting edges, and a holder of readily deformable material surrounding the blade member (or members). The edges being displaceable, relative to each other, to follow local deformation of the material.

16 Claims, 8 Drawing Sheets

FLEXIBLE SAFETY RAZORS

Conventional safety razors have blades mounted in holders of metal or of rigid or semi-rigid plastics material.

The present invention represents a substantial departure from conventional practice and resides broadly in a safety razor in which a multi-edged blade means is mounted in a holder of resilient readily deformable material which presents a skin engaging surface surrounding the blade means, different edges of the blade means being displaceable, relative to each other, to follow local deformation of the said surface.

The blade means can, of course, take various forms. In some of the embodiments illustrated below, the blade means comprise one or more flexible foils having, or each having, a plurality of apertures, preferably circular, with sharpened edges. In another embodiment, the blade means comprise individual blade strips presenting a plurality of rectilinear edges, preferably arranged in opposed pairs, the strips being interconnected by flexible straps.

In presently preferred form of the invention, the support comprises a shaped block of plastics foam material. The holder is held by the user in the manner of a small sponge which is simply rubbed, for example with a generally circular motion over the skin surface.

Such a razor is particularly, though not exclusively, designed for use by women, for example in removing hair from the legs whilst bathing. It has been found that, when used in this manner, users report the efficient removal of hair is achieved, but that the sensation is no different, or very little different from rubbing the skin with a bath sponge.

The fact that the holder is readily deformable makes it very easy to grasp, even in soapy bath water, and also enables it to conform easily to the skin contours.

One material which has already proved to be suitable for the holder is a polyethylene foam, which is readily deformable and also produces a pleasant sensation in the skin. Many other materials could, of course, be satisfactorily employed, and it would be possible to use a material having a surface layer of a different material. For example, a very soft rubber could be covered with a "pimpled" surface layer, or with a layer of foam material.

Some forms of razor in accordance with the invention will now be described in detail, by way of example, with reference to the accompanying drawings, in which:

FIGS. 5 to 12 are exploded perspective views of some further embodiments invention.

Figure 1:
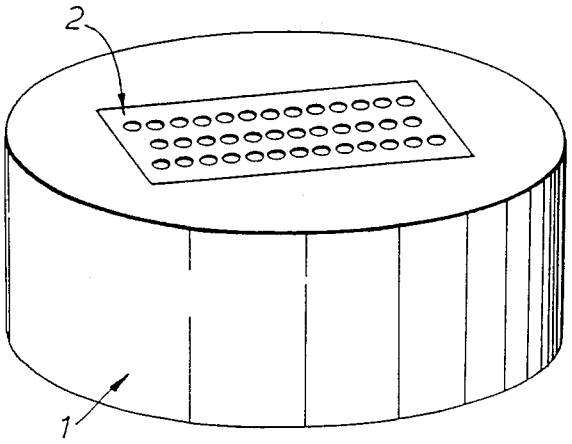
FIG. 1 is perspective view of one form of safety razor.

The razor shown in FIG. 1 comprises a holder 1 in the form of a disc of polyethylene foam material, having set in its upper face blade a member 2 in the form of a rectangular foil of conventional blade material, such as stainless steel, having a relatively large number of circular apertures whose edges are sharpened. The foil is set in a flat condition, but is capable of flexing, with the holder, to conform to local skin contours.

Figure 2:
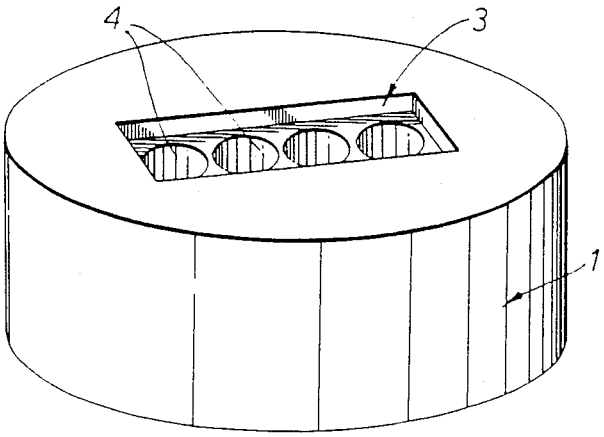
FIG. 2 is a perspective view of the holder of the razor of FIG. 1.

As shown in FIG. 2, the holder has a rectangular cavity 3 in its upper surface to receive the blade member and some through holes 4 to allow shaving debris to escape through the body of the holder.

Figure 3:
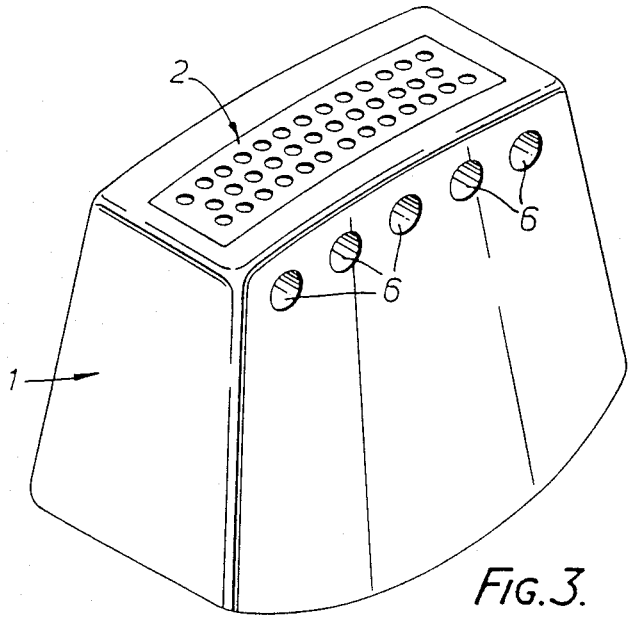
Figure 4:
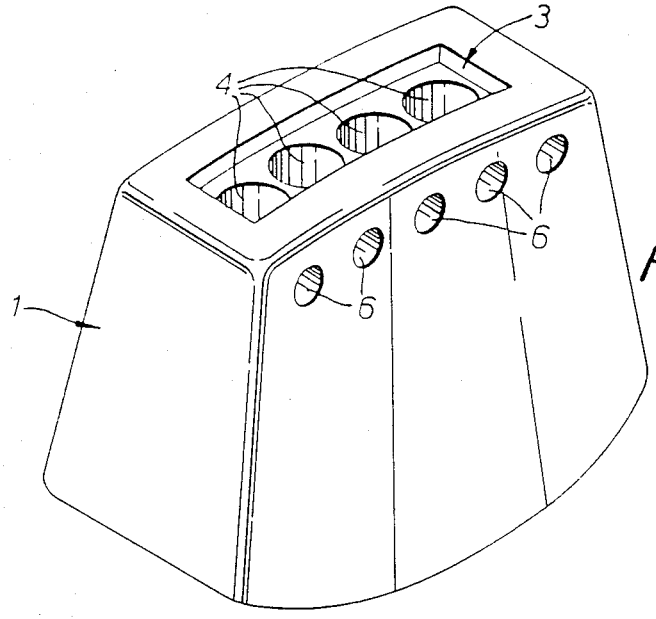

The razor shown in FIGS. 3 and 4 is of the same general construction but comprises a larger block of foam material whose upper, skin engaging surface is generally rectangular in plan and slightly convex in side elevation. The holder is also formed with some lateral holes 6 near the upper end of its side walls, to ensure adequate deformability of the holder.

Figure 5:
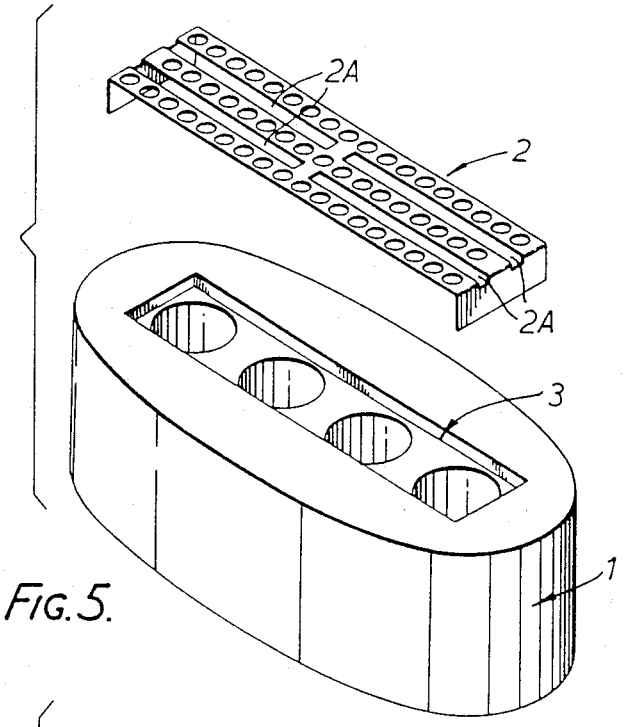
FIGS. 5 and 6 are view, corresponding to FIGS. 1 and 2, of a second form of safety razor.
Figure 6:
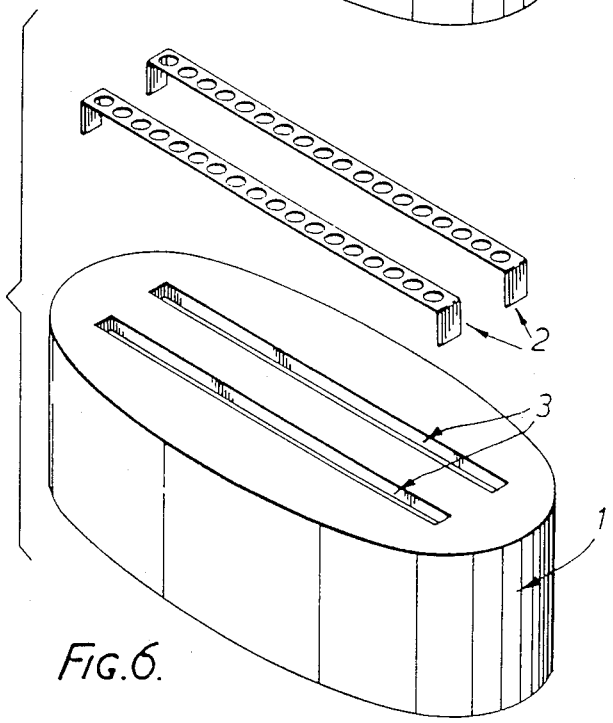
Figure 7:
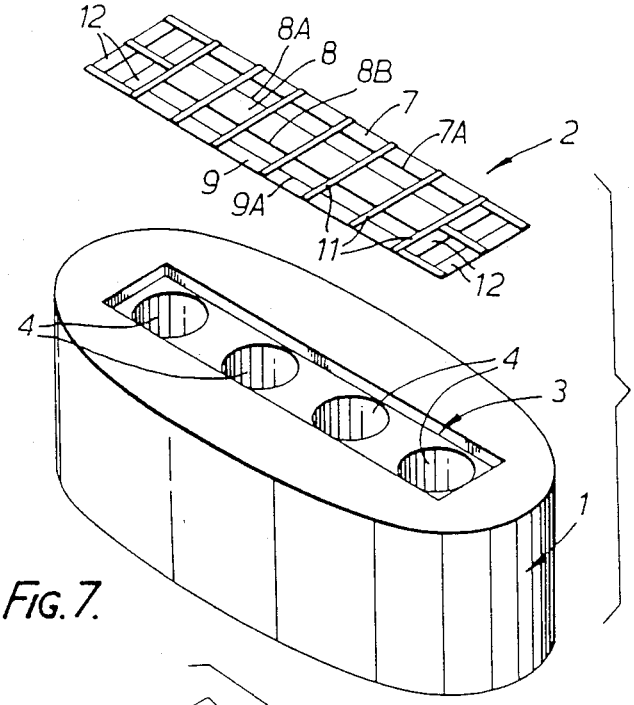

The razors of FIGS. 5, 6 and 7 are all generally similar to that of FIG. 1, but incorporate blade members of different forms.

In FIG. 5, the blade member again comprises a unitary foil 2, but it is extensively slotted at 2A between adjacent rows of apertures to increase the flexibility of the foil.

In each case described above, the holder, particularly in its skin engaging region, is highly deformable and able to conform closely to the skin contours. Because the foil is highly flexible, it is able to follow local deformations of the holder, so that the sharpened edges of the foil apertures in some regions of the foil are displaced relative to those in other regions.

In FIG. 6, two separate foils 2 are provided each comprising a single row of sharp edged apertures, the foils being independently mounted in respective recesses 3 in the holder 1.

The razor of FIG. 7 comprises a blade member 2 presenting a plurality of rectilinear blade edges. Over the major part of its length, the blade member comprises three narrow blade strips 7, 8 and 9 held in spaced parallel relation by thin, flexible connecting straps 11. The outer strips 7 and 9 have sharpened inner edges 7A, 9A, facing the respective sharpened edges 8A, 8B of the central strip 8.

At each end of the blade member there is provided a spaced pair of blade strips 12 having their inner, adjacent edges sharpened, these strips extending transversely to the length of the blade strips 7, 8 and 9.

With this arrangement, the blade member as a whole is highly flexible, so that different blade edges and different regions of individual blade edges are readily displaceable relative to each other. The connecting straps 11 also act as skin guards.

Figure 8:
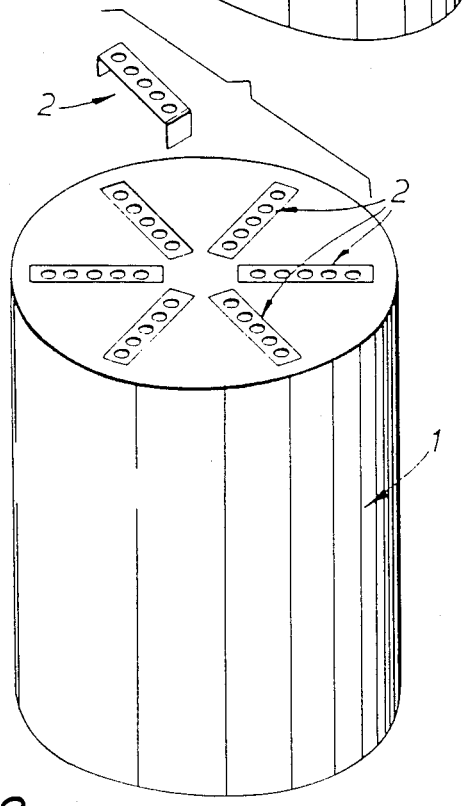

The razor shown in FIG. 8 comprises a generally cylindrical block body 1 having set into its end face a plurality of radially disposed foils 2 each presenting a single row of sharp edged apertures. One foil is shown in exploded perspective view for the sake of clarity.

Figure 9:
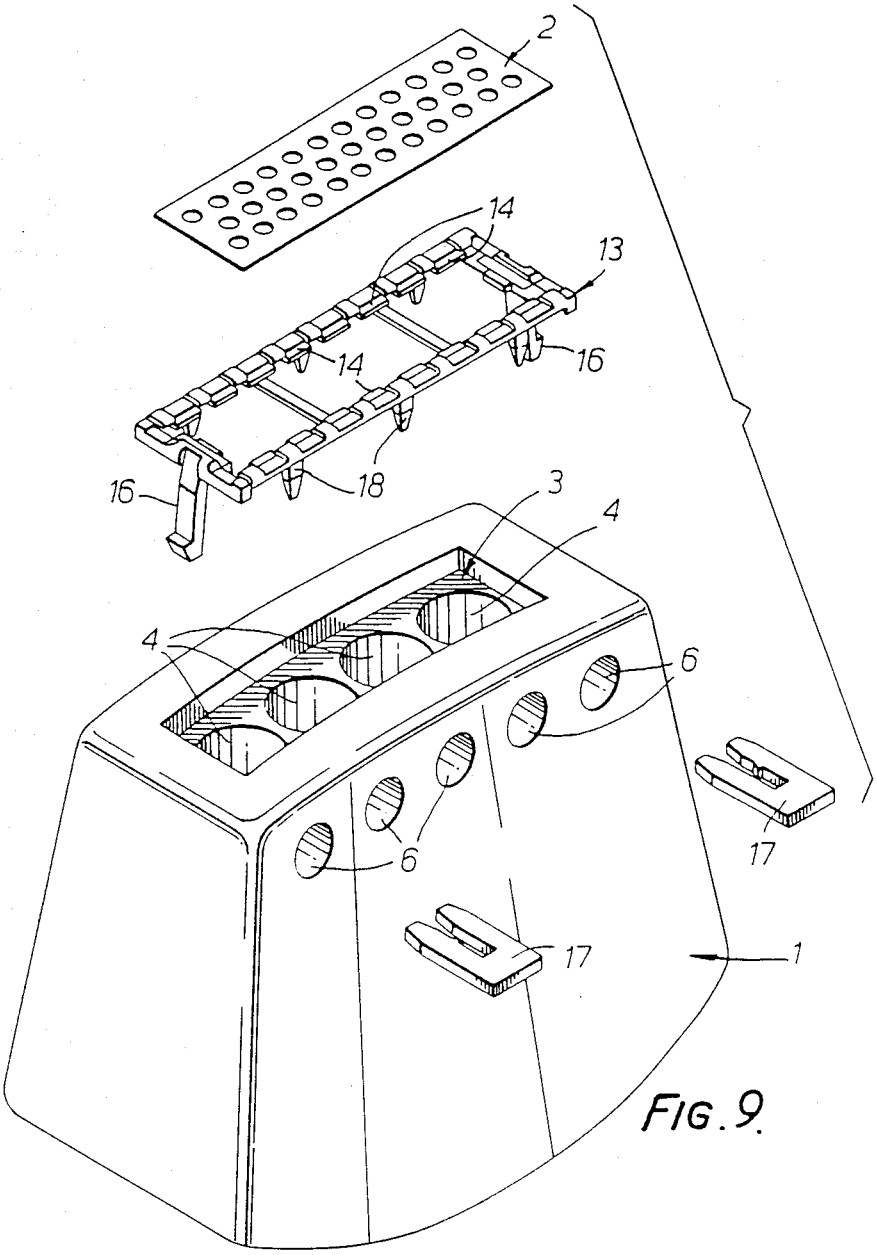

FIG. 9 illustrates a razor generally similar in form to that of FIG. 3, but whereas the latter assumes some form of bonding of the foil directly to the holder 1, the razor of FIG. 9 employs a separate frame 13 for mounting the foil on the holder. The frame is of moulded plastics construction and is highly flexible. It is of generally rectangular shape, formed on its inner periphery with inwardly directed slots 14 to receive the margins of the foil. At its opposite ends the frame has depending legs 16 which pass downwardly through the end holes 4, the lower ends of the legs being captured by slotted retainers 17 which are inserted through the end holes 6. The side members of the frame having depending prongs 18 which are pushed into the foam and body at the bottom of cavity 3.

Figure 10:
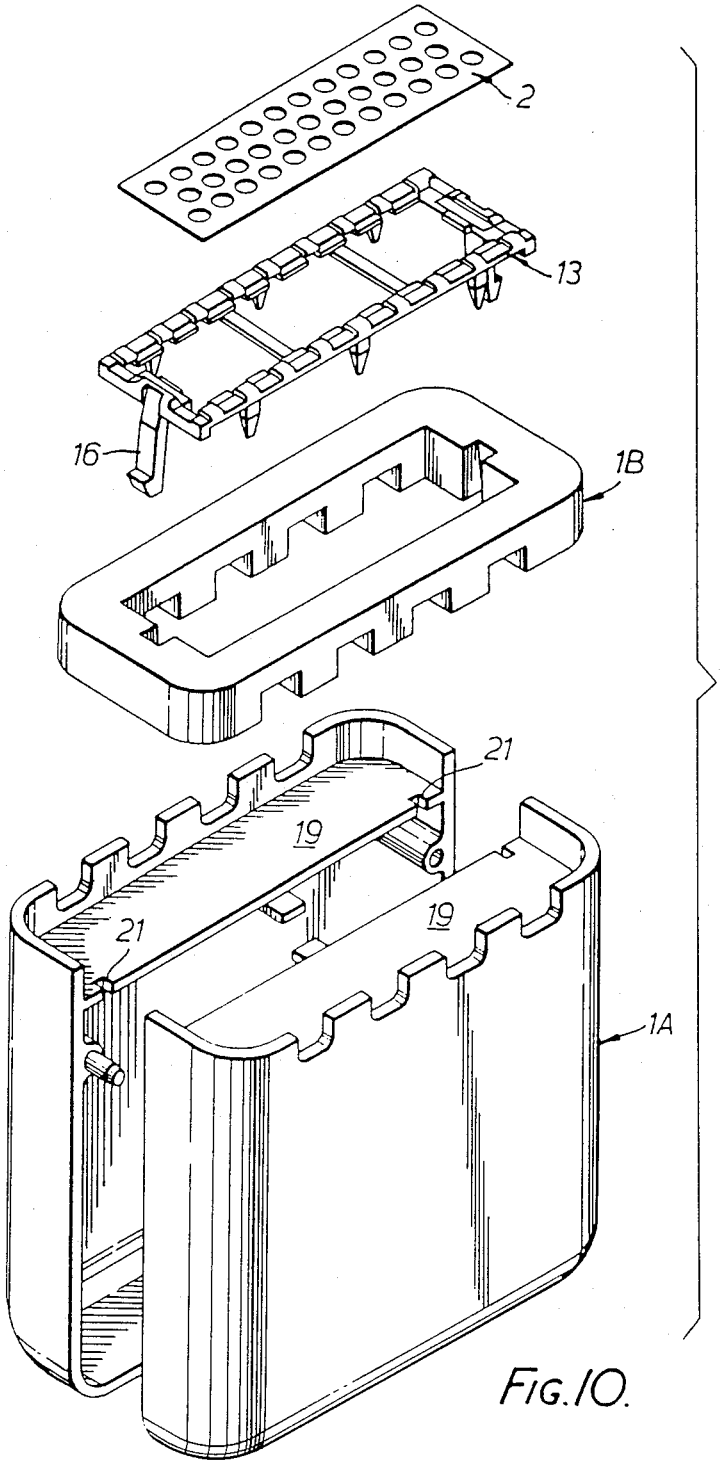

FIG. 10 shows a further variant, in which the holder comprises a lower body portion 1A made up from two moulded casing halves of relatively rigid plastics material. Transverse internal walls 19 provide a support for an upper body portion 1B of readily deformable foam material. The foil 2 and frame 13 are as shown in FIG. 9 but in this case the legs 16 clip into slots 21 formed in the walls 19.

Figure 11:
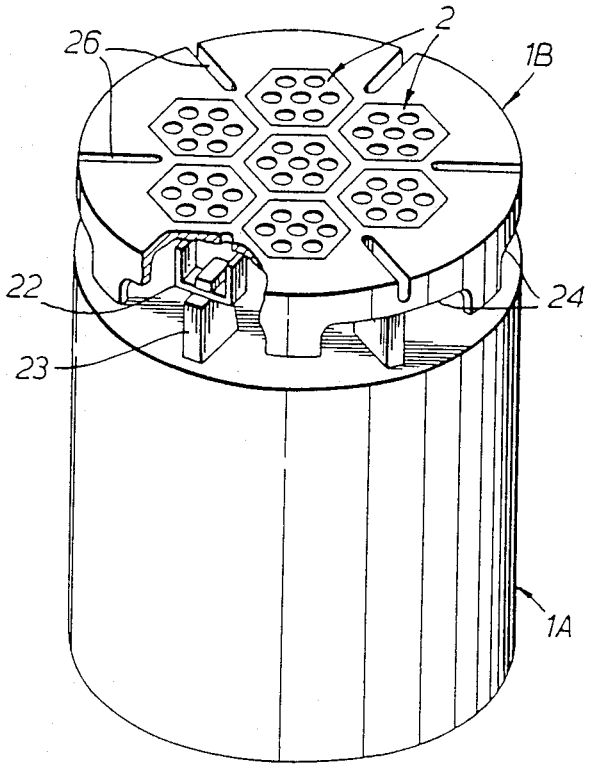

The razor of FIG. 11 is of generally cylindrical form, and comprises a relatively rigid lower body portion 1A, an upper body portion 1B of readily deformable material and a plurality of separate foils 2 set in the portion 1B. The foils are of hexagonal form, each having a number of sharp edged apertures. The portion 1B is of inverted cup-shape and has a number of channel-section brackets 22 depending from its main wall surface to engage in slots formed in upstanding support legs 23 integral with the body portion 1A. The cylindrical sidewall of the portion 1B is formed with recesses 24 which serve both to increase the flexibility of the portion and also to provide large passages for the clearance of the shaving debris. Flexibility is further enhanced by the provision of radial slots 26 in the upper surface of the portion 1B.

Figure 12A:
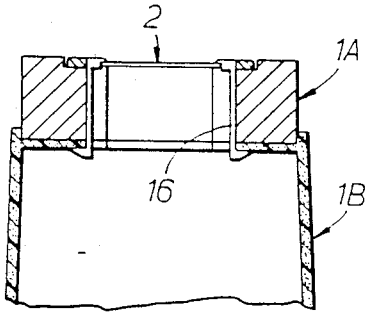
FIGS. 12A and 12B are scrap-sections on the lines AA and BB in FIG. 12.
Figure 12B:
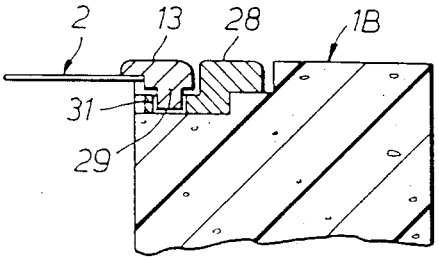
Figure 12:
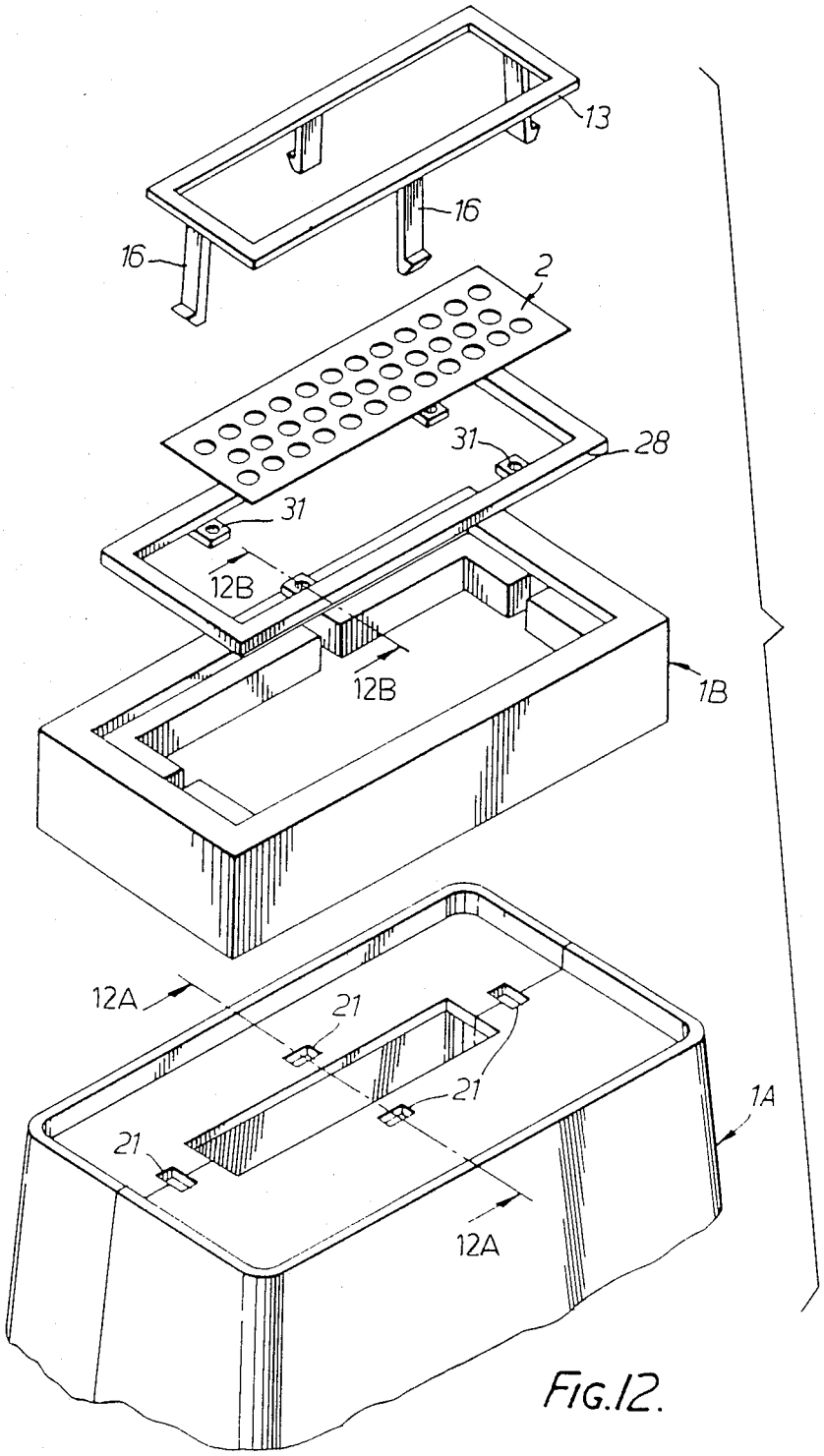

The razor illustrated in FIG. 12 is generally similar in form to that of FIG. 10 but it incorporates an additional component in the form of a rectangular frame 28 surrounding the foil and made of a material which supplies a skin conditioning agent, such as a lubricant or a moisturizer. More specifically, the frame may comprise a solid mixture of a hydrophobic polymer and a hydrophilic polymer, the hydrophilic polymer dissolving out of the mixture when wetted during shaving. The hydrophobic polymer may be polystyrene and the hydrophilic material may be polyethylene oxide, which acts as a lubricant between the skin and the blade member.

As best seen in FIGS. 12A and 12B, which are scrap sections on the lines AA and BB in FIG. 12, the foil 2 is again held by a frame 13 whose legs 16 extend downwardly through recesses in the foam body portion 1B, and clip into recesses 21 in the rigid, lower body portion 1A. The frame 13 also has depending projections 29 which engage in apertured lugs 31 integral with the frame 28 in order to clamp the latter in position.

The solid mixture material could, of course, alternatively be provided in other forms, such as in discrete elements distributed about the area occupied by blade means.

Various combinations of details of the individual embodiments described above will, of course, be possible within the scope of the invention.

Reverting to the question of the nature of the holder material, we have employed the following procedure to establish whether a given material has a suitable degree of flexibility.

A horizontal round bar, 40 mm. long and 4.75 mm. diameter is pressed into a block material 65 mm. by 35 mm. and 20 mm. thick. The block is positioned on a flat anvil with the horizontal bar centred on the centre of the block with its length parallel to the long axis of the block. The bar is advanced into the block at the rate of 40 mm./min to a maximum depth of 2.5 mm. and the rate of increase in the load is recorded. The deformability is then quoted as the rate of increase in Newtons/mm.

We have found that most materials suitable for the purpose have a resultant value in the range of 1.5 to 10 Newtons/mm. and preferably in the range of 4 to 7 Newtons/mm.

As previously stated, polyethylene foam may be employed, but various thermo-plastic, cross-linked or thermo-setting materials could be used, such as polyurethane, silicone rubber, ethyl vinyl acetate, polyvinyl chloride, polyester, polyether or blends of such materials.

We claim:

1. A safety razor comprising
a holder
multi-edged blade means mounted in said holder, and
said holder having a skin-engaging surface of material that is resilient and readily deformable that surrounds said blade means,
different edges of said blade means being displaceable relative to each other to follow local deformation of said skin-engaging surface.

2. A safety razor in which a multi-edged blade means is mounted in a holder which presents a skin-engaging surface of material that is resilient and readily deformable surrounding the blade means,
different edges of the blade means being displaceable, relative to each other, to follow local deformation of the said surface,
said holder comprising a shaped block of plastics foam material of material that is resilient and readily deformable.

3. A safety razor in which a multi-edged blade means is mounted in a holder which presents a skin-engaging surface of material that resilient and readily deformable surrounding the blade means,
different edges of the blade means being displaceable, relative to each other, to follow local deformation of the said surface,
said holder comprising a body of a soft material covered by a layer of a different material which forms the said surface of material that is resilient and readily deformable.

4. A razor according to claim 1, 2 or 3, wherein said readily deformable material which forms said engaging surface is a polyethylene foam.

5. A safety razor comprising a holder,
multi-edged blade means mounted in said holder,
said holder having a skin-engaging surface that surrounds said blade means, and
said holder being formed with a cavity in which said blade means is housed and with through holes connecting said cavity with the outside of said holder to facilitate the escape of the shaving debris,
different edges of said blade means being displaceable relative to each other to follow local deformation of said skin-engaging surface.

6. A safety razor comprising
a holder and
multi-edged blade means mounted in said holder, said blade means comprising thin flexible metal foil blade means having a plurality of apertures whose edges are sharpened to constitute individual edges of said blade means,
said holder having a skin-engaging surface that surrounds said blade means,
different edges of said blade means being displaceable relative to each other to follow local deformation of said skin-engaging surface.

7. A razor according to claim 6, wherein the blade means consists of a single foil of generally rectangular form.

8. A razor according to claim 6, wherein said blade means consists of a unitary foil member having parallel rows of said apertures, and wherein said foil member is slotted, between adjacent rows of apertures, to increase the flexibility of the foil.

9. A razor according to claim 6, wherein said blade means comprises a plurality of individual foil members, each said foil member having a plurality of said apertures, and being mounted independently in said holder.

10. A razor according to claim 9, wherein each said foil member is of elongate form, and has a row of said apertures.

11. A razor according to claim 10, wherein the said foil members are set parallel with each other in said holder.

12. A razor according to claim 10 in which said foil members are set to extend radially from a central region of said holder.

13. A razor according to claim 9, wherein said foil members are each of polygonal form.

14. A razor according to claim 6 or 7, further comprising a flexible frame member for receiving said foil, blade means frame being firmly secured to said holder.

15. A razor according to any one of claims 1, 2 or 5, wherein said blade means comprises a plurality of rectilinear blade strips each having at least one rectilinear cutting edge, said strips being individually flexible and bodily displaceable relative to each other.

16. A razor according to any one of claims 1,2 or 6 wherein the said holder is mounted on a body member of relatively rigid construction.

* * * * *

UNITED STATES PATENT AND TRADEMARK OFFICE

CERTIFICATE OF CORRECTION

PATENT NO. : 4,964,214

DATED : October 23, 1990

INVENTOR(S) : Norman C. Welsh et al.

It is certified that error appears in the above-identified patent and that said Letters Patent is hereby corrected as shown below:

Col. 1, line 57, "FIGS. 5 and 6" should be --FIGS. 3 and 4--.

Col. 4, lines 27 and 28, delete "of material that is resilient and readily deformable".

Col. 4, lines 38 and 39, delete "of material that is resilient and readily deformable".

Signed and Sealed this

Third Day of March, 1992

*Attest:*

HARRY F. MANBECK, JR.

*Attesting Officer*

*Commissioner of Patents and Trademarks*